United States Patent [19]

Ogata et al.

[11] 4,257,742

[45] Mar. 24, 1981

[54] DEVICE FOR INTERCONNECTING TURBINE BLADES

[75] Inventors: Hisao Ogata, Yokohama; Michinobu Fujii, Hiratsuka, both of Japan

[73] Assignee: Tokyo Shibaura Denki Kabushiki Kaisha, Kanagawa, Japan

[21] Appl. No.: 26,164

[22] Filed: Apr. 2, 1979

[30] Foreign Application Priority Data

Apr. 3, 1978 [JP] Japan ..... 53-38914

[51] Int. Cl.[3] ..... F01D 5/22

[52] U.S. Cl. ..... 416/190; 416/191; 416/196 R

[58] Field of Search ..... 416/190, 191, 196 R

[56] References Cited

U.S. PATENT DOCUMENTS

| | | | |
|---|---|---|---|
| 1,554,614 | 9/1925 | Allen | 416/190 |
| 2,942,843 | 6/1960 | Sampson | 416/190 |
| 3,290,004 | 12/1966 | Ishibashi | 416/190 |
| 3,751,182 | 8/1973 | Brown | 416/191 |
| 4,025,232 | 5/1977 | Imai et al. | 416/191 |
| 4,028,006 | 6/1977 | Kuroda et al. | 416/191 |

FOREIGN PATENT DOCUMENTS

| | | | |
|---|---|---|---|
| 982484 | 1/1976 | Canada . | |
| 1374917 | 8/1964 | France | 416/190 |
| 45-38086 | 12/1970 | Japan | 416/191 |
| 51-85011 | 7/1976 | Japan . | |

*Primary Examiner*—Everette A. Powell, Jr.

*Attorney, Agent, or Firm*—Stevens, Davis, Miller & Mosher

[57] ABSTRACT

A device for interconnecting turbine blades comprises a pair of projections extending towards each other from the opposing sides of the tips of adjacent blades, having an inclined inward surface, and having a radially extending perforation. A cover piece has a pair of inclined outward surfaces conforming to the inward surfaces of the projections. The cover piece also has lugs extending through the perforations in the projections. One of the lugs has its end peened to form an overhang for abutting the projection. The perforation of the opposite projection is elongated to permit untwist of the turbine blades.

4 Claims, 11 Drawing Figures

DEVICE FOR INTERCONNECTING TURBINE BLADES

BACKGROUND OF THE INVENTION

The present invention relates to a device for interconnecting turbine blades, and more particularly to such a device with an improved cover piece mounted between the tips of the turbine blades.

Generally, turbine blades are rotated at a high speed, and those in the low-pressure final stage are particularly long and are twisted to a greater extent, so that a greater centrifugal force acts on the blades and untwisting deformation occurs. Moreover, the degree of vibration increases as the length of the turbine blades is increased. To eliminates the problems of the untwisting deformation and the vibration, it is desired to provide a device for interconnecting the turbine blades which is effective in enhancing the rigidity of the turbine blades and in damping the vibration.

Prior art devices for interconnecting turbine blades have disadvantages in that they are not capable of permitting untwisting deformation in various forms so that great stresses are created in the turbine blades and the interconnecting member, and that they do not provide a sufficient damping effect.

SUMMARY OF THE INVENTION

An object of the invention is to provide a device for interconnecting turbine blades which has an improved capability of permitting untwisting deformation and of damping the vibration.

According to the invention, there is provided a device for interconnecting turbine blades mounted on the periphery of a rotor and extending radially outwardly therefrom, which comprises: a pair of projections extending towards each other from the opposing sides of the tip portions of adjacent ones of the turbine blades, and having a radially inward surface inclined in such a manner that the distance between each point on the radially inward surface and the axis of the turbine is increased towards the end of each projection, and having a perforation formed to extend substantially radially through each projection, and a cover piece having a pair of radially outward surfaces inclined to conform to the radially inward surfaces of the pair of projections and having a pair of lugs extending substantially radially outwardly from the respective radially outward surfaces and through the respective perforations in the pair of projections, one of the lugs having the end thereof peened to form an overhang for abutting the projection, the perforation of the opposite projection being elongated in the direction of movement of the other lug due to untwist of the turbine blades.

DESCRIPTION OF THE INVENTION

Figure 1:
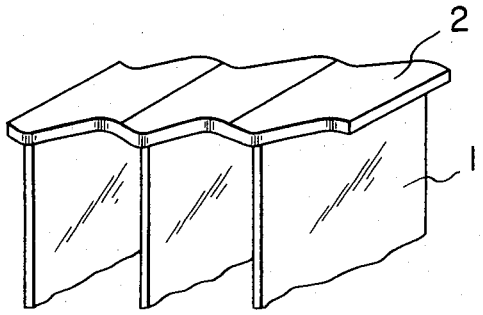
FIG. 1 PRIOR ART
FIG. 1 is a perspective view showing an example of conventional device for interconnecting turbine blades.

FIG. 1 shows an example of conventional device for interconnecting turbine blades, wherein turbine blades 1 mounted on the periphery of a rotor, not shown, are grouped, and each group of the turbine blades 1 are interconnected by a shroud 2 for the purposes of enhancing rigidity.

However, in the device of FIG. 1, adjacent turbine blades are securely fastened to each other by the shroud 2, so that untwisting stress due to centrifugal force is induced in the turbine blades 1 and the shroud 2. Besides, no damping effect is expected.

Figure 2:
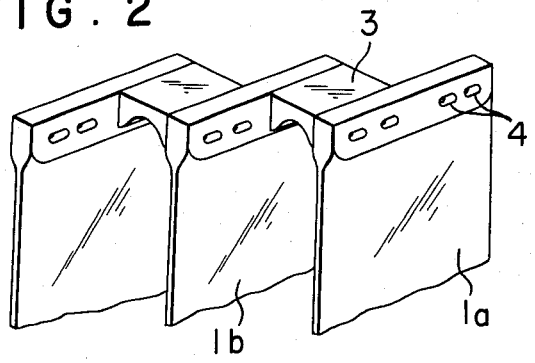
FIG. 2 PRIOR ART
FIG. 2 is a perspective view showing another example of conventional device for interconnecting turbine blades.
Figure 3:
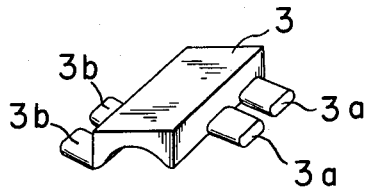
FIG. 3 PRIOR ART
FIG. 3 is a perspective view showing a cover piece incorporated in the device shown in FIG. 2.

FIGS. 2 and 3 show another examples of conventional device for interconnecting turbine blades which comprises cover pieces 3 interposed between adjacent blades and each provided with lugs 3*a* and 3*b* extending through holes 4 in the tips of adjacent turbine blades 1*a* and 1*b*. With this device, untwisting deformation along the length of the lugs 3*a* and 3*b* are permitted to a certain extent.

However, deformation of the turbine blades occurs not only along the length of the lugs, but also in radial direction. Moreover, vibration is combined with the deformation due to centrifugal force.

Figure 4:
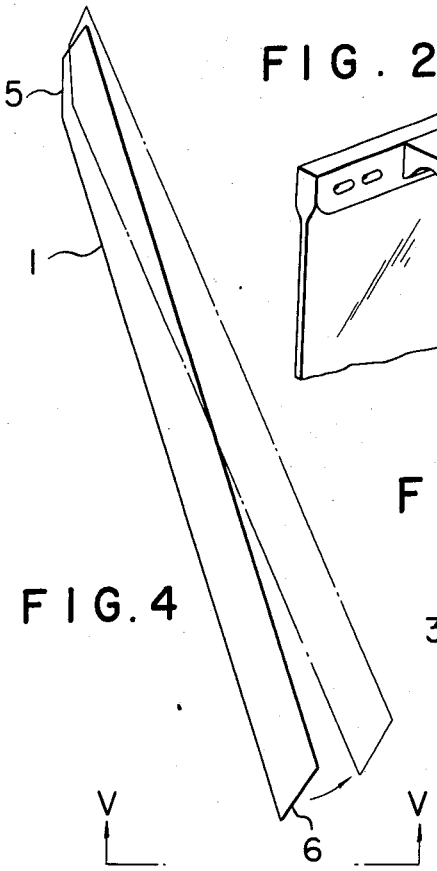
FIG. 4 is a radial view showing deformation of a turbine blade due to untwist.

As illustrated in FIG. 4, untwisting deformation occurs in each turbine blade when centrifugal force is exerted (solid line to chain line). At the same time, displacement in the radial direction (vertical direction as viewed in FIG. 5) is greater at the trailing edge 6 than at the leading edge 5. The vibration alternately increases and decreases the distance between adjacent turbine blades.

The device shown in FIGS. 2 and 3 does not permit the relative radial movement between the leading edge and the trailing edge caused by the untwist of the turbine blades, and stresses are induced in the turbine blades and the cover piece 3.

Also the cover pieces 3 have to be assembled at the same time when the turbine blades are mounted to the rotor, and when the last cover piece is inserted, the adjacent turbine blades need be twisted and bent in order to provide sufficient space for the insertion of the cover piece 3.

FIGS. 6 through 10 show an embodiment of the invention.

Figure 6:
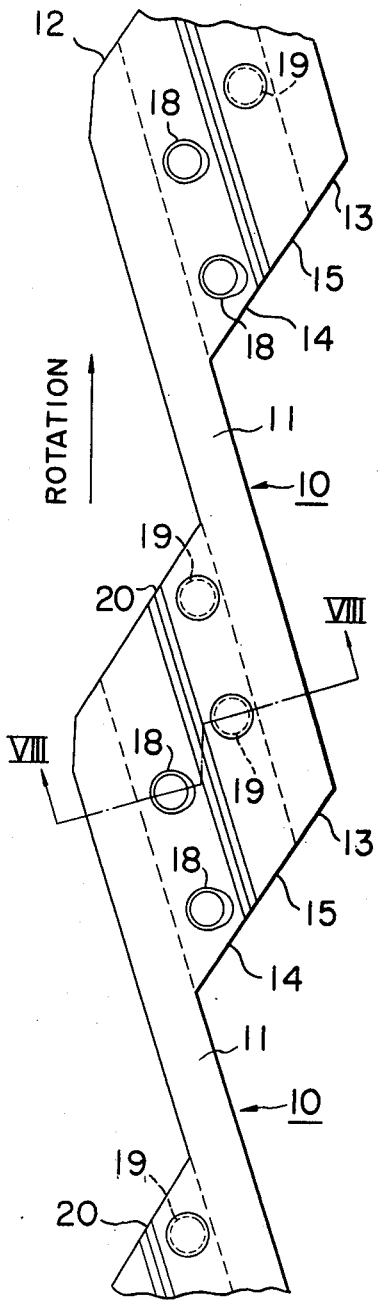
FIG. 6 is a radial view showing a device for interconnecting turbine blades according to an embodiment of the invention.

In FIG. 6, denoted by numeral 10 are turbine blades mounted on the periphery of a rotor, not shown, and extending radially outwardly from the rotor. A first projection 14 is provided near the leading edge 12 of the tip portion 11 of each blade 10. A second projection 15 is provided near the trailing edge 13 of the tip portion 11 of each blade 10. The first projection 14 on one blade and the second projection 15 on an adjacent blade are formed to extend towards each other respectively from the suction side 25*a* of the blade 10 and from the pressure side 25*b* of the blade 10. The first projection 14 has a radially inward surface 16 inclined relative to the radial direction of the turbine in such a manner that the distance between each point on the inclined surface 16 and the axis of the turbine is increased towards the end of projection 14. The second projection 15 is similarly formed. The first projection 14 has a pair of perforations 18 formed to extend substantially radially therethrough. The perforations 18 are slightly elongated in a direction described later. The second projection 15 also has a pair of perforations 19 formed to extend substantially radially therethrough.

Figure 7:
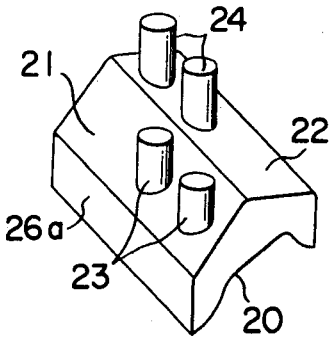
FIG. 7 is a perspective view showing a cover piece incorporated in the device shown in FIG. 6.
Figure 8:
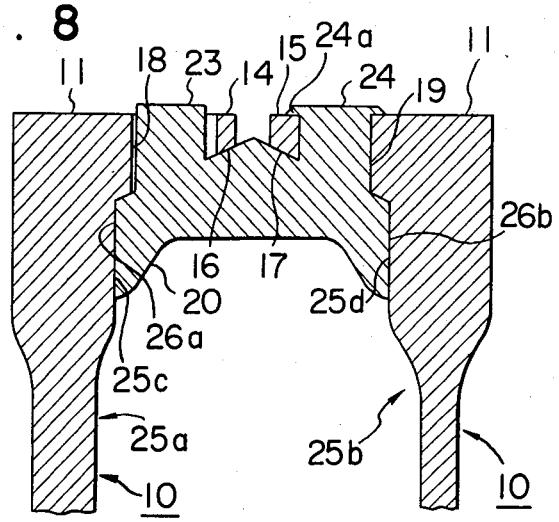
FIG. 8 is a sectional view taken along the line VIII—VIII in FIG. 6.

A cover piece 20 is disposed between the suction side 25*a* of the leading portion of one blade and the pressure side 25*b* of the trailing portion of an adjacent blade, and under the projections 14 and 15. The cover piece 20 has a substantially parallelogram profile when viewed radially and, as shown in FIG. 7, has a pair of radially outward surfaces 21 and 22 which are inclined to conform respectively to the radially inward surfaces 16 and 17 of the opposing projections 14 and 15. The cover piece 20 has pairs of lugs 23 and 24 extending substantially outwardly from the respective outward surfaces 16 and 17, and through the respective perforations 18 and 19 in the projections 14 and 15.

The lugs 24 extending through the perforations 19 in the projection 15 have the end thereof peened for forming an overhang 24*a* (FIG. 8) so that the lugs 24 are loosely fastened to the projection 15. The perforations 18 in the projection 14 are elongated in a direction of movement of the lugs 23 due to untwist, so that a limited play is permitted.

The suction side 25*a* of the blade has a radially extending flat portion 25*c*, with which a flat side 26*a* of the cover piece 20 is in contact. Similarly, the pressure side 25*b* of the blade has a radially extending flat portion 25*d*, with which a second flat side 26*b* of the cover piece 20 is in contact.

In assembly, the cover pieces 20 is disposed between the blades and the lugs 23 and 24 are made to penetrate the perforations 18 and 19, and then the ends of the lugs 24 are peened. Such disposal of the cover pieces may be achieved after the turbine blades are fixed to the rotor.

Figure 9:
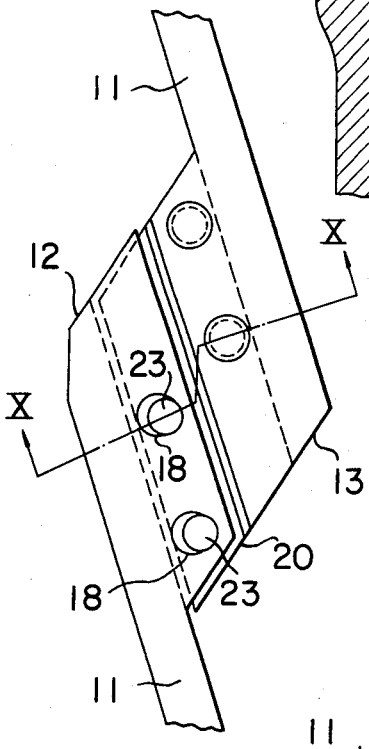
FIG. 9 is a radial view of the device shown in FIG. 6, with the turbine blades being deformed.
Figure 10:
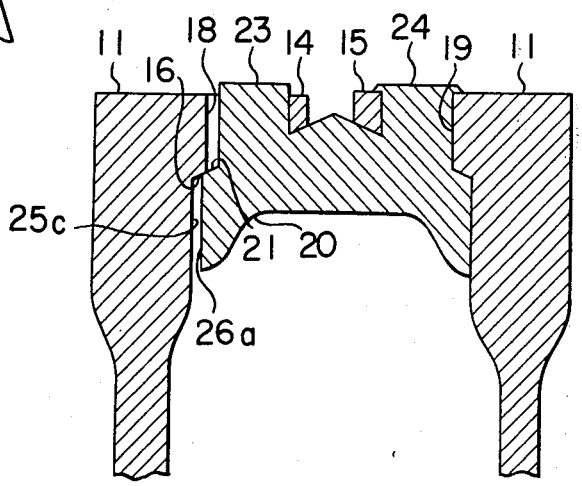
FIG. 10 is a sectional view similar to FIG. 8, with the turbine blades being deformed.

When the turbine rotates, centrifugal force causes the blades 10 to be deformed as illustrated in FIG. 4, so that the distance between adjacent blades is increased. The deformation is permitted as far as the lugs 23 are permitted. to move along the elongated perforations 18, i.e., up to a point where the lugs 23 come to engage the extremities of the elongated perforations 18 (FIG. 9, FIG. 10).

Figure 5:
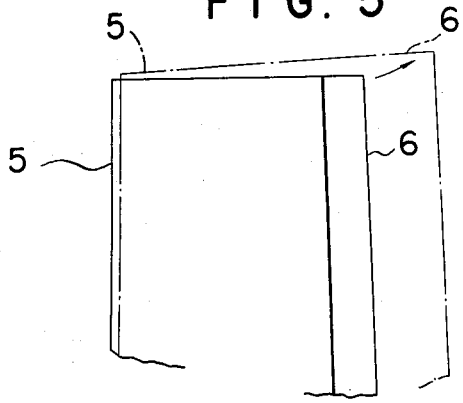
FIG. 5 is an axial view showing deformation of a turbine blade due to untwist.

The untwist also tends to cause the difference in displacement between the leading edge and the trailing edge, as illustrated in FIG. 5. Such deformation is permitted as the lugs 23 shifts along the elongated perforations 18 and as the cover piece 20 pushes up the projection 14 and hence the leading portion of the tip of the blade.

Thus, deformation due to untwist is permitted within a certain limit, and deformation beyond such limit is prevented by the engagement of the lugs 23 with the extremities of the elongated perforations 18 and by the resistance induced by the strain in the turbine blade because of the lifting of the leading portion.

Vibration takes place in various directions. The vibration component in the direction of the elongation of the perforations 18 is dampted by the friction between the surface 21 of the cover piece 20 and the surface 16 of the projection 14. The vibration component in the radial direction is damped by the friction between the free side 26*a* of the cover piece 20 and the flat surface 25*c* of the suction side 25*a* of the blade, and also by friction between the surface 21 of the cover piece 20 and the surface 16 of the projection 14. Friction between the surface 21 of the cover piece 20 and the surface 16 of the projection 14 is particularly effective because the surface 21 is pressed with a great contact pressure against the surface 16 due to the fact that the untwist tends to cause a greater displacement in the trailing portion than in the leading portion.

Moreover, since the lugs 24 are loosely fastened to the projection 15, a limited play is allowed between the cover piece 20 and the projection 15. This is effective in permitting untwisting deformation. In addition, the friction between the surface 22 of the cover piece 20 and the surface 17 of the projection 15, as well as the friction between the side surface 26*b* of the cover piece 20 and the flat portion 25*d* of the side 25*b* of the blade also serve to damp the vibration.

Furthermore, the collision between the surfaces 21 and 22 of the cover piece 20 and the surfaces 16 and 17 of the projections 14 and 15, as well as the collision between the surfaces 26*a* and 26*b* of the cover piece 20 and the flat portions 25*c* and 25*d* of the blades also serve to damp the vibration.

The angle of inclination of the surfaces 16, 17, 21 and 22 is perferably 23°, and may be varied within a range of from about 20° to about 30°, depending on the various conditions.

Figure 11:
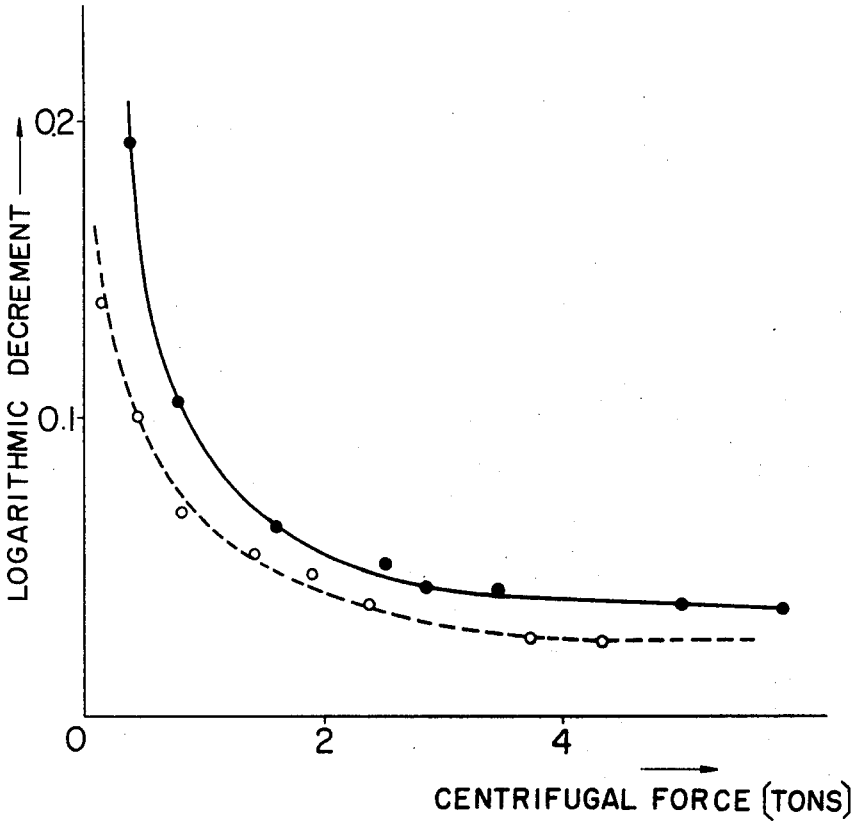
FIG. 11 is a graph showing results of comparison tests of the conventional interconnecting device shown in FIGS. 2 and 3 and an interconnecting device according to the invention.

Comparison tests were carried out to find the damping effects of an interconnecting device according to the invention and the conventional interconnecting device shown in FIGS. 2 and 3. The results of the tests are shown in FIG. 11, wherein logarithmic decrements are plotted against centrifugal forces. A logarithmic decrement is a logarithm of a ratio of $A_i/A_{i+1}$, wherein $A_i$ is a peak value in any given cycle of a damped vibration and $A_{i+1}$ is a peak value in the next cycle. The logarithmic decrement therefore indicates the rate at which the vibration is damped or attenuated. The angle of inclination of the surfaces 16, 17, 21 and 22 of the device according to the invention was 23°. It is apparent from FIG. 11 that the logarithmic decrement of the device according to the invention (solid line) is superior to that of the conventional device (broken line) under every centrifugal force tested.

What is claimed is:

1. A device for interconnecting turbine blades mounted on the periphery of a rotor and extending radially outward therefrom, comprising:

a turbine blade comprising a tip portion, a suction side, a pressure side, a leading section, and a trailing section;

a pair of projections exending from the tip portion of the turbine blade, one of said projections extending from the leading section of the suction side of said turbine blade, the other projection extending from the trailing section of the pressure side of said turbine blade, a radially inward surface on each of said projections, extending outwardly from said turbine blade such that as the radial inward surface extends outward from said turbine blade, the radial distance from the rotor to the radially inward surfaces is enlarging, at least two perforations on each projection extending substantially radially through each projection, the perforations on the suction side of the blades being elongated;

a cover piece having a pair of radially outward surfaces inclined to conform to the radially inward surfaces on said projections from the blades, a plurality of lugs, extending radially from each of said radially outward surfaces, said lugs extending substantially radially outwardly from said cover piece through said perforations in said projections, the plurality of lugs extending through the perforations extending from the pressure side of the blade being peened to form an overhang for abutting the projection.

2. A device according to claim 1, wherein the suction side of each blade has a substantially radially extending flat surface adjacent to said inclined surface of the projection, and said cover piece further comprises a substantially radially extending flat surface engageable with said radially extending flat surface of the suction side of each blade.

3. A device according to claim 1, wherein the pressure side of each blade has a substantially radially extending flat surface adjacent to said inclined surface of the projection, and said cover piece further comprises a substantially radially extending flat surface engageable with said radially extending flat surface of the pressure side of each blade.

4. A device according to claim 1, wherein the angle of inclination of said radially inward surface of each projection is within the range of from about 20° to about 30°.

* * * * *